United States Patent [19]

Deering

[11] Patent Number: 4,738,178

[45] Date of Patent: Apr. 19, 1988

[54] ELECTRIC STRINGED INSTRUMENT HAVING SOUND CHARACTERISTICS OF BANJOS AND GUITARS

[76] Inventor: Charles G. Deering, 7936-D Lester Ave., Lemon Grove, Calif. 92045

[21] Appl. No.: 915,780

[22] Filed: Oct. 6, 1986

[51] Int. Cl.[4] ..... G10H 3/18; G10D 1/08; G10D 1/10; G10D 15/00

[52] U.S. Cl. ..... 84/1.16; 84/1.15; 84/171; 84/267; 84/269

[58] Field of Search ..... 84/1.04, 1.06, 1.14, 84/1.15, 1.16, DIG. 24, 170, 171, 263, 269, 267

[56] References Cited

U.S. PATENT DOCUMENTS

| | | | |
|---|---|---|---|
| 2,725,778 | 12/1955 | Cromwell | 84/DIG. 21 |
| 3,192,304 | 6/1965 | Rizzutti | 84/1.15 |
| 3,633,452 | 1/1972 | Beasley | 84/263 |
| 3,668,295 | 6/1972 | Broussard | 84/1.16 |
| 3,780,202 | 12/1973 | Law | 84/1.16 |
| 4,290,331 | 9/1981 | Izdebski | 84/DIG. 24 |
| 4,450,744 | 5/1984 | Shubb | 84/1.16 |

*Primary Examiner*—Stanley J. Witkowski
*Attorney, Agent, or Firm*—Frank D. Gilliam

[57] ABSTRACT

An improved electric stringed instrument which can produce "banjo" sounds. The instrument has a banjo head including a taut flexible membrane mounted on a ring which is mounted on a solid material (preferably wood) body. The ring and body are connected in a conventional manner to a fretted neck extending away from the head. A plurality of strings extend from adjustable securing means at the end of the neck over the flexible membrane to a tailpiece secured to the body. A bridge is positioned between the strings and membrane. One or more recesses in the body below the membrane contain electric pickups. The spaces between the sides and bottoms of the pickups and the adjacent surfaces of the recesses are at least partially filled with resilient foam. The foam beneath the pickups is compressed slightly to keep the upper pickup surface in resilient contact with the membrane. Closing in the chamber under the head where the pickups are located restricts the airflow in the chamber and reduces the vibration of the head sufficiently to allow high volume without the feedback problems normally associated with prior amplified banjos. Amplifying the signal generated by the pickup under the bridge will give one sound, while amplifying the forward pickup signal will produce another different sound, providing a variety of banjo sounds.

22 Claims, 2 Drawing Sheets

ELECTRIC STRINGED INSTRUMENT HAVING SOUND CHARACTERISTICS OF BANJOS AND GUITARS

BACKGROUND OF THE INVENTION

This invention relates in general to electric stringed instruments and, more specifically, to an improved instrument which can selectively produce more variety of banjo sounds and louder banjo sound than previously possible.

Since the development of electric amplification techniques and equipment for stringed instruments many efforts have been made to both produce higher quality sound and to produce new and different sounds than those produced by prior instruments but all attempts have left banjos with a limitation of sound volume significantly lower than electric guitars due to feedback generated by the head of the banjo when the sound vibration of the music causes excessive vibration of the head. Prior electric banjos with wood bodies do not have volume difficulties but lost the banjo sound because the essential taut membrane was discarded. Early attempts at electrically reproducing banjo sounds used a pickup transducer placed in contact with the taut membrane or the string supporting bridge or both. Law, in U.S. Pat. No. 3,780,202, placed the pickup on a movable bracket within the banjo housing to contact the backside of the taut membrane. While this arrangement does very well at picking up the vibrations of the membrane, severe limitations are encountered when the volume is turned up comparable to an electric guitar, the head vibrates more as the volume increases which causes the instrument to feed back. Pickups have been directly attached to the bridge, for example pickups have been clipped to the bridge itself as described by Cronwell in U.S. Pat. No. 2,725,778 or embedded in a foot of the bridge itself as described by Shubb in U.S. Pat. No. 4,450,744. Unfortunately, these arrangements tend to change the vibration characteristics of the bridge, resulting in tone distortion and still have the volume limitations because the head is not sufficiently dampened from excessive vibration at high volume. These distortions or changes in the sound produced by amplification where taken to an extreme by Rizutti who describes in U.S. Pat. No. 3,192,304 a pickup located on the upper surface of the membrane, fastened to the bridge, which produces "new sounds such as no other electric fretted instrument is able to produce". This still leaves the head free to vibrate and cause feedback.

Thus, there is a continuing need for improvements in stringed instruments to provide improvements in the quality of amplified sound and have the capability of producing greater volume without distorting feedback.

SUMMARY OF THE INVENTION

The above-noted problems, and others, are overcome by the electric stringed instrument of this invention, which basically includes a normal banjo head made up of a taut flexible membrane mounted on a ring which is then mounted on a solid body. A fretted neck is fastened to the body in a conventional manner and strings extend from an adjustable securing means at the end of the neck over the banjo head to a tailpiece secured to the body. A bridge is positioned between the strings and membrane. One or more recesses are formed in the body below the strings. Electric pickups in the recesses are in contact with the underside of the membrane, one preferably below the bridge and another preferably between the bridge and the neck attachment end of the head. Spaces between the sides and bottoms of the pickups and sides and bottoms of the recesses are at least partially filled with a pad of resilient foam material. The foam beneath the pickups is compressed slightly to maintain the upper surface of the pickups in resilient pressure contact with the underside of the membrane. While foam is preferred, springs could be used in place of the foam, if desired. Preferably a thin sheet of felt is positioned between pickup upper surface and membrane lower surface.

The banjo may be designed with any style of neck, for banjo players or guitar players, mandolin players, etc. The choice of sounds via the tone control, volume control, and pickup switch allow the musician more choices than ever before possible for banjo players. It opens up many possibilities to produce a unique, distinctive and variable sound.

The body may be circular and fit within a normal banjo housing so that the instrument resembles a normal banjo except for the weight of the solid body replacing the normally hollow banjo housing. Alternatively, the body may have a shape corresponding to any desired guitar shape with the banjo head inset into the upper surface and the flexible membrane spaced slightly from the upper body surface. The airspace under the membrane should be closed to the outside so as to dampen the vibration of the membrane and thus reduce feed back.

BRIEF DESCRIPTION OF THE DRAWING

Details of the invention, and of preferred embodiments thereof, will be further understood upon reference to the drawing, wherein.

DETAILED DESCRIPTION OF THE INVENTION

Figure 1:
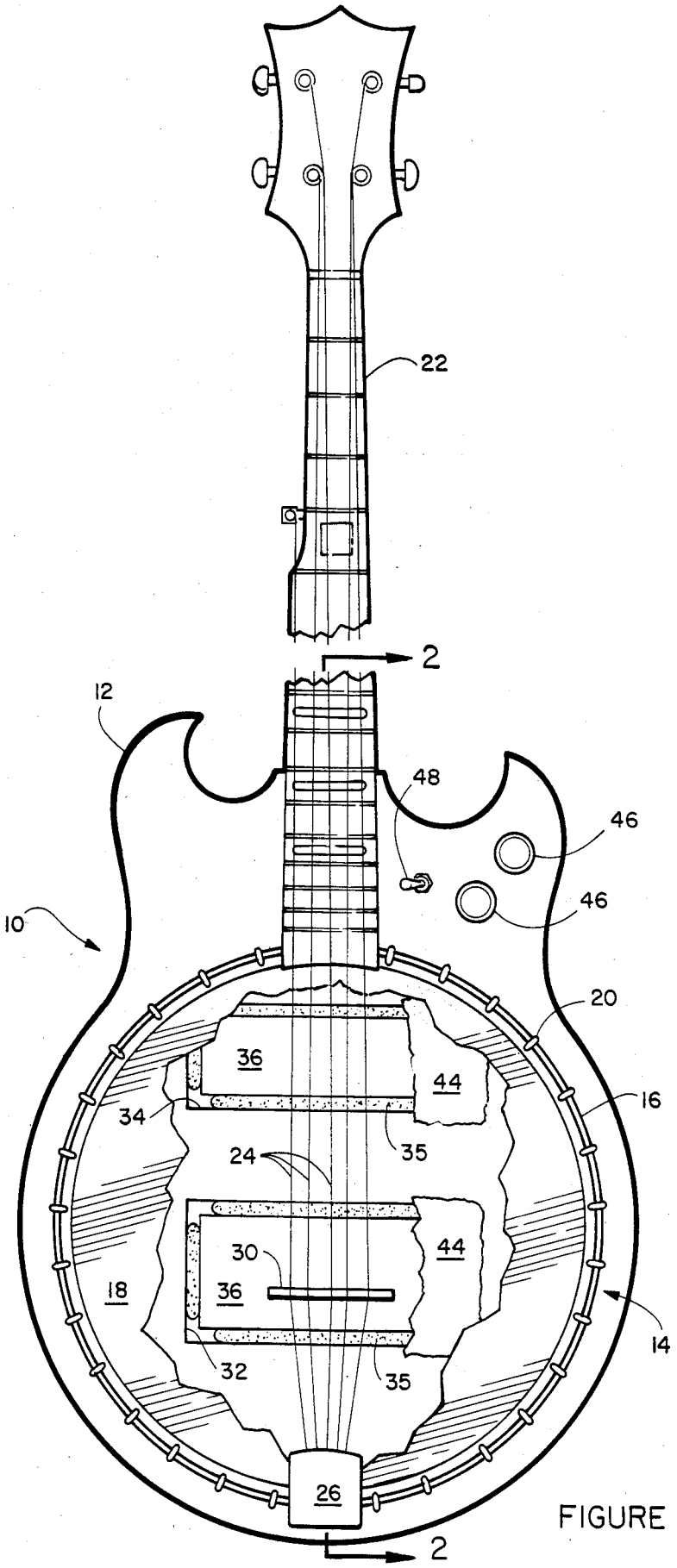
FIG. 1 is a plan view, partially cut-away of my electric stringed instrument in the guitar bodied configuration.
Figure 2:
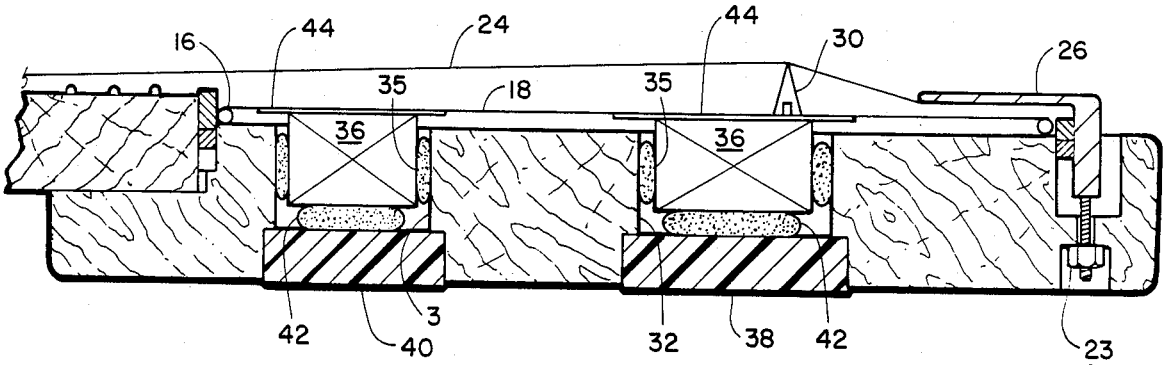
FIG. 2 is a vertical section view taken on line 2—2 in FIG. 1.

Referring now to FIGS. 1 and 2, there is seen a stringed musical instrument 10 having a solid body 12 in the general configuration of a standard guitar. While body 12 may be formed from any suitable material, wood is preferred for strength, stiffness and optimum resonant characteristics. Secured to the top of body 12 is a tension hoop consisting of a ring 16 which is fastened to a taut flexible membrane 18. Typically, ring 16 is metal and membrane 18 is MYLAR plastic or sheepskin. A plurality of generally "J" shaped bolts 20 extend over ring 16 and extend down into body 12 into nuts countersunk into body 12 from below (not seen in the figures) to hold ring 16 to body 12 in a conventional manner.

A fretted neck 22 extends away from one end of body 12. A plurality of strings 24 are secured to the end of neck 22 by adjustable screws. Strings extend down neck 22 and across membrane 18 to a tailpiece 26 to which they are secured. Tailpiece 26 is held to body 12 by a bolt and nut arrangement 23. A bridge 30 is positioned between membrane 18 and strings 24. As is conventional with banjos, bridge 30 is not fastened to either strings 24 or membrane 18 but is held in place by tension between those two elements.

One or more recesses 32 and 34 are located within body 12, a first recess 32 preferrably beneath bridge 30 and the second recess 34 forward of the bridge. Each recess is adapted to hold a conventional electric stringed instrument pickup 36. Typical of such pickups are those available from Gibson, Fender, EMG, Seymore Duncan, Alembic under the tradename Humbucking, or any other suitable pickup. Spaces between the sides of pickups 36 and the side walls of recesses 32 and 34 are at least partially filled with resilient foam pads 35 to flexibly position the pickup at the center of the recess. The bottoms of recesses 32 and 34 are formed by removable plugs 38 and 40 which can be removed to allow removal of pickups 36 through the underside of body 12. Pressure at pickups 36 on membrane 18 can be varied by the thickness of the foam pads or the extent to which plugs 38 and 40 are inserted. Plugs 38 and 40 may be typically molded from plastic and may be removably held in place by screws (not shown) extending upwardly through the plugs into body 12. Electrical wires (not shown) can be run from pickups 36 out through holes in plugs 38 and 40 or through any suitable holes in body 12. A resilient foam pad 42 is placed between plugs 38 and 40 and pickups 32 and 34, respectively, to gently urge the pickups upwardly into light pressure contact with the underside of membrane 18 which significantly reduces feedback. Preferrably a thin sheet 44 of felt or the like is secured to the upper surfaces of pickups 36 in order to provide positive reduction of feedback, and still allow vibration of the flexible membrane.

Signals from pickups 36 may be directed to a conventional amplification and speaker system. Controls 46 may be provided to adjust the volume and tone of the signals to the amplifier using conventional electrical circuitry. A three-way switch 48 may be provided to select either pickup or use them both together.

Figure 3:
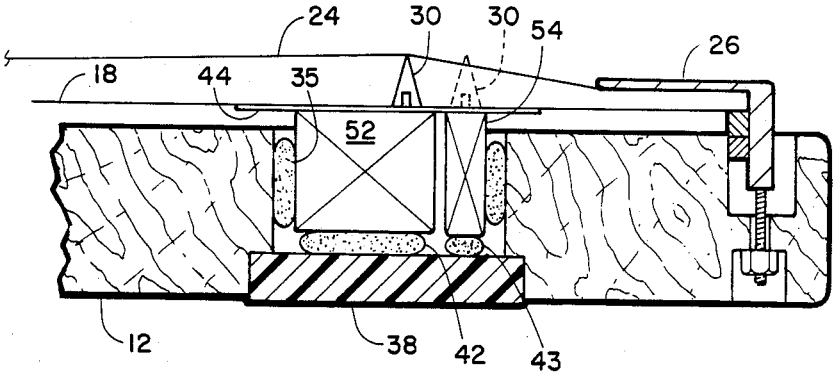
FIG. 3 is a detail vertical section view through an embodiment using as alternate pickup, taken on a line corresponding to line 2—2 in FIG. 1.

FIG. 3 shows in section an alternative embodiment of the pickup arrangement shown in FIGS. 1 and 2 which produces additional variations in the sound produced. In this case, a pickup 52 having a tone bar or anti-feedback bar 54 adjacent to one end is mounted adjacent a side pad 35 and a small bottom pad 43 in the manner discussed above. Significant here is the anti-feedback or feedback eliminating tone bar which further dampens the head and stops the microphone effect. The bridge position is not actually changed but the position of the pickup can be changed to affect its alignment with the bridge.

Figure 4:
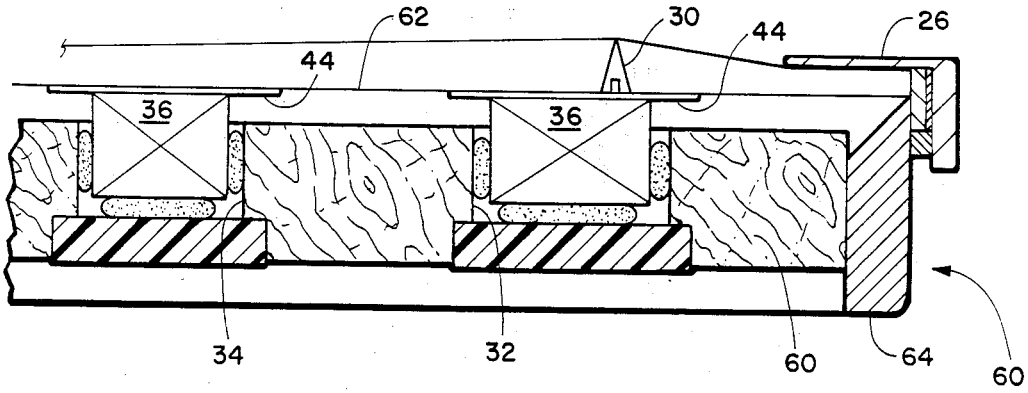
FIG. 4 is a detail vertical section view through an embodiment having a banjo bodied configuration, taken on a line corresponding to line 2—2 in FIG. 1.

FIG. 4 shows another variation of my instrument in section, corresponding in general to the section shown in FIG. 2. Here, rather than a body 12 having a configuration of a conventional guitar with a banjo head 14 fastened to the upper surface as seen in FIGS. 1 and 2, the body is a conventionally configured banjo housing 60 having a taut flexible membrane 62 secured to a circular wooden hoop 64. The instrument has the appearance of a normal banjo. Here, however, a circular solid (preferably wooden) insert 66 one or more pickups 36 in recesses 32 and 34 as discussed above is fastened within hoop 64 with the felt layer 44 on the pickups in resilient contact with the underside of membrane 62. The upper surface of the insert 66 is preferably spaced up to about ¼ inch from the membrane 62. This instrument functions just as the guitar configured instrument shown in FIGS. 1 and 2 but has the outward appearance of a banjo. Further, with properly sized inserts 66, almost any banjo can be converted to an instrument performing in the manner permitted by my invention. This also closes the airspace under the membrane dampening its vibration thus reducing feedback.

While certain preferred arrangements, configurations and materials were detailed in the above description of preferred embodiments, these may be varied, where suitable, with similar results. For example the guitar-appearing embodiment may be shaped to appear as any conventional or unconventional guitar and reinforced plastics or other composites may be used in place of wood if desired.

Other variations, applications and ramifications of this invention will occur to those skilled in the art upon reading this disclosure. Those are intended to be included within the scope of this invention, as defined by the appended claims.

I claim:

1. In a stringed musical instrument comprising a banjo head including a taut, thin flexible membrane mounted on a ring, a fretted neck extending away from said head, a plurality of strings adjustably secured to said fretted neck at the extended end thereof, said strings extending over said flexible membrane and being secured to a tailpiece at the side of said head opposite said neck, a bridge between said strings and said membrane and at least one pickup means for translating vibrations of said strings and membrane into electrical signals, the improvement wherein:

said head is mounted on a solid body which extends to a position just under said membrane;

said body has at least one recess located adjacent to said strings;

said at least one recess being sized to loosely receive a pickup; and the spaces between the sides and bottoms of said pickup means and said at least one recess being at least partially filled with resilient suspension means;

the suspension means below said pickup means being at least slightly compressed to cause the upper surface of said pickup means to be pressed against the underside of said membrane.

2. The improvement according to claim 1 further including thin felt sheets positioned between said pickup upper surfaces and said membrane underside.

3. The improvement according to claim 1 where said at least one pickup is located beneath said bridge and the signal from that pickup when amplified produces a sound substantially corresponding to a normal banjo sound without the feedback normally found in amplified banjos.

4. The improvement according to claim 3 where said at least one pickup includes a tone bar at the end away from said neck and said bridge is adapted to be selectively positioned over the pickup or over the tone bar.

5. The improvement according to claim 1 wherein two pickups are utilized, one pickup is located beneath said membrane immediately under said bridge and a second pickup is located beneath said membrane at a location between said bridge and said neck whereby the signals from the two pickups when amplified produce a unique blended sound.

6. The improvement according to claim 1 wherein said body consists of a solid insert carrying said recesses and adapted to be fitted within a normal banjo housing to bring said at least one pickup into resilient contact with the underside of the membrane.

7. The improvement according to claim 1 wherein, said recesses extend entirely through said body and removable plugs are fitted in the open lower ends of said recesses to form a bottom surface for said recesses and to hold said at least one pickup in place and allow adjustment of the pressure of the pickup on said membrane.

8. The improvement according to claim 1 wherein said suspension means comprises resilient foam pads.

9. An electric pickup assembly for use with stringed musical instruments having a banjo head which comprises:

a solid body adapted to be secured to said instrument with a substantially planar upper body surface slightly below the undersurface of the banjo head;

a first recess extending downwardly into said body;

said first recesses located immediately below the instrument bridge;

a first electrical pickup positioned in said first recess;

foam pad means positioned between the walls of said recess and said first electrical pickup;

the foam pad below said pickup having sufficient thickness to resiliently bias said electrical pickup means upper surface against the underside of the banjo head.

10. The invention as defined in claim 9 further comprising a second recess located below the instrument strings to one side of said bridge and a second pickup positioned in said second recess.

11. The assembly according to claim 10 further including thin felt sheets positioned between said pickup upper surface and said banjo head underside.

12. The assembly according to claim 10 where said pickup below said bridge includes a tone bar adjacent to one end and said bridge is adapted to be selectively positioned over the pickup or over the tone bar.

13. The assembly according to claim 10 wherein said body consists of a solid insert carrying said recesses and adapted to be fitted within a normal banjo housing to bring said pickups into resilient contact with the underside of the membrane.

14. The improvement according to claim 10 wherein said recesses extend entirely through said body and removable plugs are fitted in the open lower ends of said recesses to form a bottom for said recesses and to hold said pickups in place.

15. A stringed musical instrument comprising:

a banjo head including a taut, thin, flexible membrane mounted on a ring;

a fretted neck extending away from said head;

a plurality of strings extending over said neck and head from adjustable securing means at the end of said neck to a tailpiece at the opposite end of the instrument;

a bridge between said strings and membrane;

a solid body means having a substantially planar upper surface secured in a closely spaced relationship to the undersurface of said membrane;

two recesses in the upper surface of said body, one adjacent to said bridge and at least one adjacent to said strings at a location spaced from said bridge;

an electrical pickup positioned within each recess and spaced from the walls thereof;

resilient foam pads at least partially filling the spaces between said walls and pickups; and the foam pad beneath each pickup having sufficient thickness to resiliently bias each pickup against the underside of said membrane.

16. The instrument according to claim 15 further including thin felt sheets positioned between the pickup upper surfaces and said membrane underside.

17. The instrument according to claim 15 where one pickup is located beneath said bridge and the signal from that pickup when amplified produces a sound substantially corresponding to a normal banjo sound.

18. The instrument according to claim 17 where said pickup includes a tone bar at one end and said bridge is adapted to be selectively positioned over the pickup or over the tone bar.

19. The instrument according to claim 15 where the signals from the two pickups when amplified produce a unique blended sound.

20. The instrument according to claim 15 wherein said body consists of a solid insert carrying said recesses and adapted to be fitted within a normal banjo housing to bring said pickups into resilient contact with the underside of the membrane.

21. The instrument according to claim 15 wherein said recesses extend entirely through said body and removable plugs are fitted in the open lower ends of said recesses to form a bottom to said body and to hold said pickups in place.

22. The instrument according to claim 15 wherein the space between said membrane and said body is sealed so as to prevent air movement between said space and the outside air.

* * * * *